United States Patent [19]

Basconi

[11] Patent Number: 4,847,443

[45] Date of Patent: Jul. 11, 1989

[54] ROUND TRANSMISSION LINE CABLE

[75] Inventor: Paul D. Basconi, Cheshire, Conn.

[73] Assignee: Amphenol Corporation, Wallingford, Conn.

[21] Appl. No.: 210,386

[22] Filed: Jun. 23, 1988

[51] Int. Cl.[4] ..... H01B 7/08; H01B 7/34

[52] U.S. Cl. ..... 174/32; 174/36; 174/115; 174/117 R; 174/117 F

[58] Field of Search ..... 174/32, 36, 115, 117 R, 174/117 F, 117 FF

[56] References Cited

U.S. PATENT DOCUMENTS

| | | | |
|---|---|---|---|
| 3,179,904 | 4/1965 | Paulsen | 174/36 |
| 4,230,898 | 10/1980 | Emmel | 174/117 F X |
| 4,490,690 | 12/1984 | Suzuki | 174/117 FF X |
| 4,767,891 | 8/1988 | Biegon et al. | 174/36 X |

FOREIGN PATENT DOCUMENTS

| | | | |
|---|---|---|---|
| 388405 | 6/1965 | Switzerland | 174/117 FF |
| 2176926 | 1/1987 | United Kingdom | 174/117 F |

OTHER PUBLICATIONS

Hoser, G. P. et al; Flat Shielded Tubing for External Signal Cable; IBM Technical Disclosure Bulletin; vol. 16, No. 5; Oct. 1973.

Schinko, Herwig; Flat Cables as Transmission Elements for Digital Systems; Siemens Review XL11; 1975; No. 3.

*Primary Examiner*—Morris H. Nimmo

*Attorney, Agent, or Firm*—Bacon & Thomas

[57] ABSTRACT

A transmission line cable formed from a plurality of generally flat transmission line segments stacked together in interlocking relation is disclosed. The cable maintains consistent electrical characteristics in its individual conductors while permitting configuration into a round cable that can be mass terminated.

10 Claims, 3 Drawing Sheets

ROUND TRANSMISSION LINE CABLE

BACKGROUND OF THE INVENTION

1. Field of the Invention

This invention is directed to a transmission line cable which allows ribbon cable segments to be formed into a round shape while maintaining a controlled relationship of signal and ground conductors so that the resulting electrical characteristics are consistent and uniform.

2. Description of the Prior Art

Flat transmission line cable, commonly referred to as ribbon cable, is widely used to facilitate mass terminations. Unlike multiconductor round cable, the conductors in ribbon cable remain in the same position with respect to a reference and can be connected to a mass termination connector, without the need to trace each individual conductor to its source. In conventional round cable, the multiple conductors twist and undulate within the cable so that it is impossible to determine by inspection without the use of color codes whether the relationship of the conductors at the end of the cable is the same as at the beginning of the cable, and mass termination techniques cannot be utilized.

While round cable is disadvantageous from the point of view of mass termination, it possesses other properties which provide advantages over ribbon cable. In particular, round cable is easier to shield, bends in any direction for easier handling and installation, and has a more compact profile for some applications.

In view of the distinct advantages of round cable in terms of shielding and handling, it has been proposed to configure ribbon cable into a round shape by folding the ribbon cable against itself and extruding a plastic jacket in a round configuration thereover. The ribbon cable is thereby configured into a round shape but can be reconfigured as ribbon cable by stripping away the round jacket and unfolding the ribbon cable. The unfolded ribbon cable can then be mass terminated in the normal manner.

Prior attempts to configure ribbon cable into a round shape by folding and jacketing did not address the variations that occur with electrical characteristics. In such configurations, impedance and capacitance variations can be relatively high due to the position of the conductors when the ribbon cable is folded and cannot be considered controlled from a transmission line cable perspective, as the tolerances usually associated with such cable are relatively tight. The position of the conductors caused by folding the ribbon cable can also lead to increases in crosstalk.

Accordingly, there remains a need in the art for a transmission line cable with controlled and predictable electrical characteristics, which combines the handling and shielding advantages of round cable and the advantages of mass termination of ribbon cable.

SUMMARY OF THE INVENTION

It is, therefore, a primary object of the invention to configure a ribbon transmission line cable into a round shape and still maintain consistent and uniform electrical characteristics.

The foregoing object is achieved by providing a transmission line cable comprised of a plurality of generally flat transmission line segments stacked together in an interlocking manner. Each segment comprises a generally flat insulating material having disposed therein at least one signal conductor and ground conductors on opposite sides of said signal conductor. Each segment is configured so as to have alternating regions of reduced and expanded thickness which can receive corresponding regions of expanded and reduced thickness in an adjacent segment with which it is stacked. The segments are stacked together in the cable such that every signal conductor is surrounded by ground conductors. By surrounding each signal conductor with ground conductors, consistent and uniform electrical characteristics are maintained and crosstalk is inhibited. A protective jacket surrounds the plurality of stacked transmission line segments forming a round transmission line cable.

BRIEF DESCRIPTION OF THE FIGURES OF DRAWING

DETAILED DESCRIPTION OF THE PREFERRED EMBODIMENTS

Figure 1:
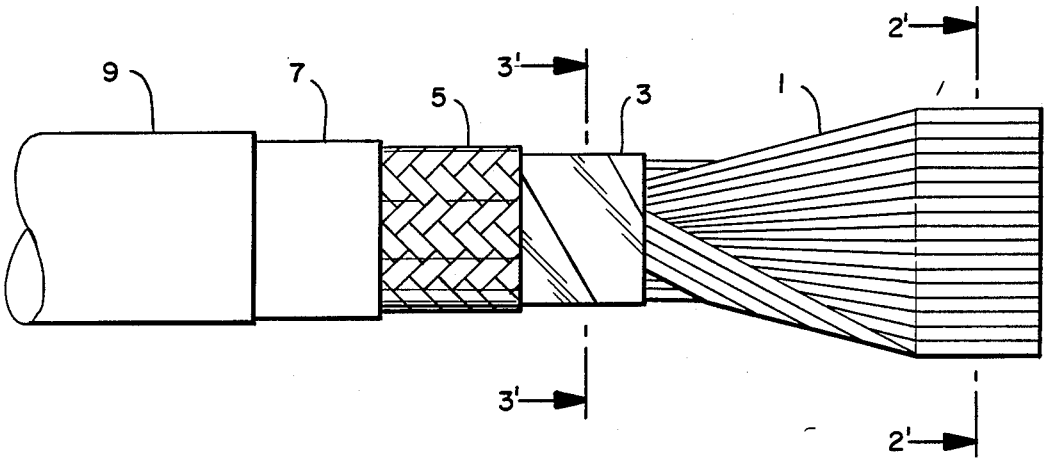
FIG 1 PRIOR ART
FIG. 1 is an elevational view of a prior art cable in which a ribbon cable is folded together into a round cable.

Referring to FIG. 1, a prior art cable in which ribbon cable is folded together and jacketed into a round cable is shown. Ribbon cable 1 is folded against itself and wrapped with tape 3 into a round cross sectional configuration. A metal braid 5 is applied over the tape to provide added shielding and strength. A paper liner 7 is placed over the braid. Finally, jacket 9 is extruded cver the entire structure to form a jacketed round cable. When the jacket, liner, braid and tape are stripped away, the ribbon cable can be unfolded for mass termination.

Figure 2:
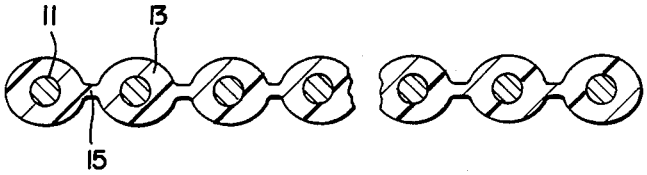
FIG 2 PRIOR ART
FIG. 2 is a cross sectional view of the ribbon cable depicted in FIG. 1, taken along line 2'–2'.

FIG. 2 shows a cross sectional view of the ribbon cable in its unfolded state. The cable contains a plurality of individual conductors 11 disposed within insulating material 13. A web of insulating material 15 connects adjacent insulated conductors to maintain the continuous ribbon-like structure. Ribbon cable, as depicted in this figure, is typically made by aligning the individual conductors and continuously extruding insulating material, such as polyvinyl chloride, therearound.

Figure 3:
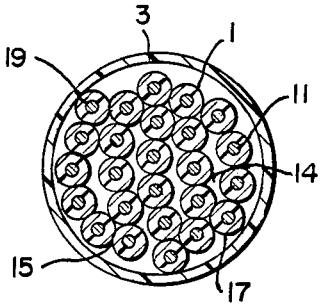
FIG 3 PRIOR ART
FIG. 3 is a cross sectional view of the folded ribbon cable depicted in FIG. 1, taken along line 3'–3'.

FIG. 3 shows the folded ribbon cable 1 with tape 3. As is evident from this figure, the cable extends from the first conductor 19 to the last conductor 17. At some points there are spaces 14 between the tape 3 and/or adjacent rows of insulated conductors, while at other points 15 adjacent insulated conductors contact one another. Because of this positioning of the conductors, inconsistencies in electrical characteristics occur. Moreover, the lack of shielding between adjacent conductors can cause undesirable levels of crosstalk.

Figure 4:
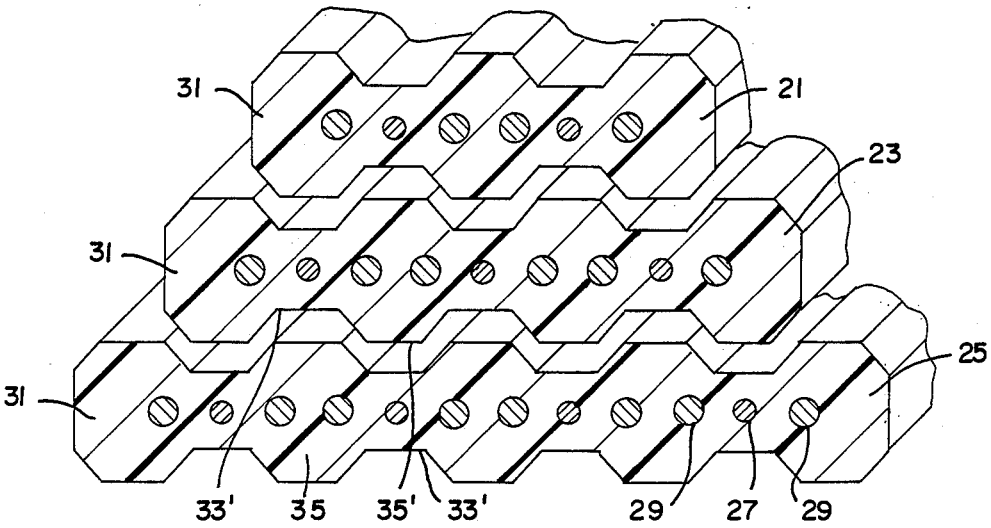
FIG. 4 is an elevational view of individual transmission line segments used to form the transmission line cable of the invention.
Figure 5:
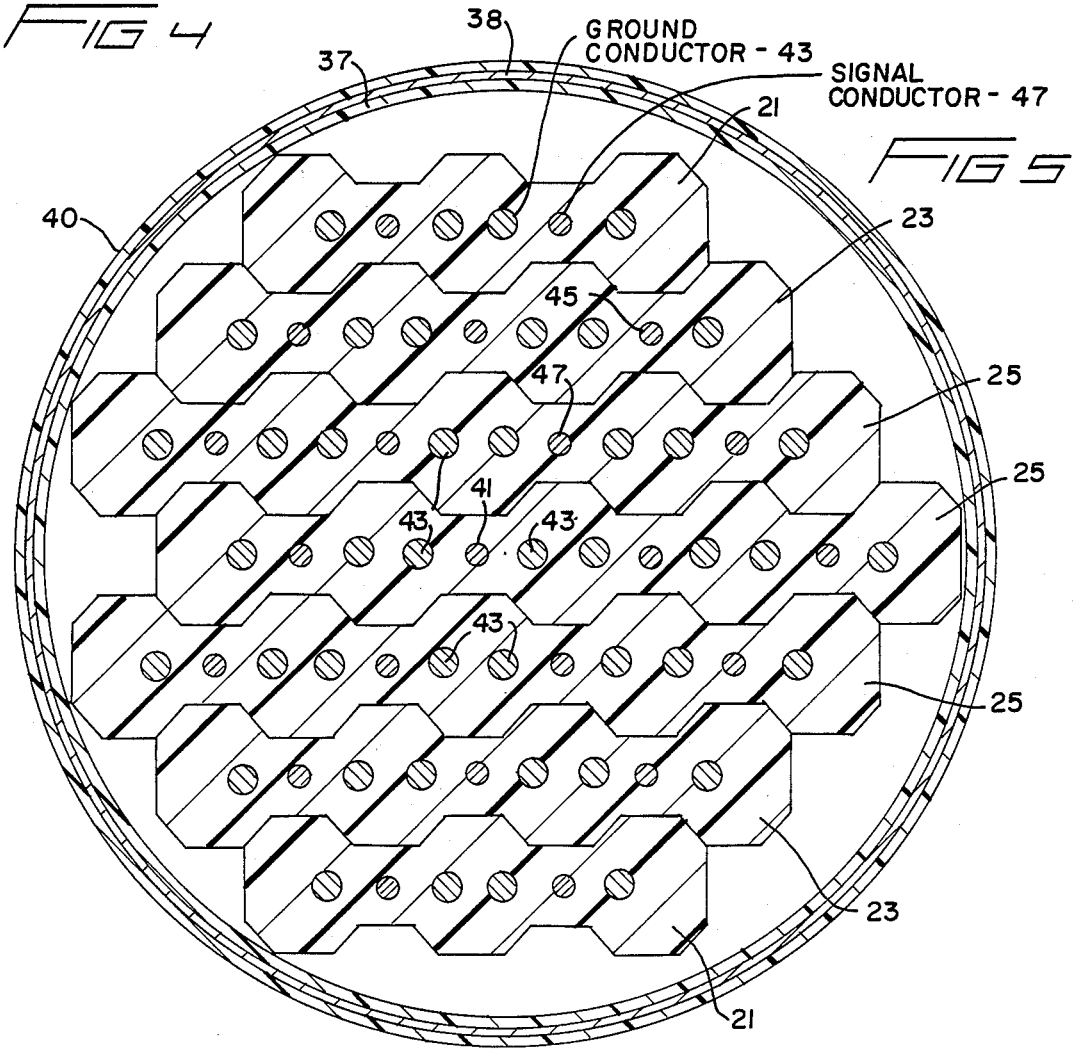
FIG. 5 is a cross sectional view of the transmission line cable of the invention in which a plurality of transmission line segments are stacked together.

Referring to FIGS. 4 and 5, the transmission line cable of the invention is seen to be comprised of a plurality of individual transmission line segments 21, 23 and 25, of indefinite length and varying widths. Each segment contains at least one signal conductor 27 surrounded on either side by ground conductors 29. Segment 21 has two signal conductors, while segments 23 and 25 have three and four signal conductors, respectively. The conductors are disposed within an insulating material 31 which may be any polymeric material that can be shaped or extruded into the transmission line segments, such as polyvinyl chloride, polyethylene, polypropylene and fluorinated ethylene propylene. These materials are extruded over the conductors in a conventional manner. The extrusion die is configured so that while each segment is generally flat, each contains alternating regions of reduced and expanded thickness 33 and 35, respectively, which are adapted to receive a corresponding region of expanded and reduced thickness 35' and 33' of an adjacent segment when they are stacked together. As shown in FIGS. 4 and 5, the region of expanded thickness has an octagonal shape which is received in interlocking relation with a corresponding region of reduced thickness.

The widths of the segments are varied to accommodate additional signal conductors and to provide a round cable when the segments are properly stacked together and wound with tape 37, as shown in FIG. 5. In this figure, the width of the segments vary from segments 21 having two signal conductors to segments 25 having four signal conductors. However, it is to be understood that different combinations of segments of varying width are possible, so long as the final stacking has a generally round cross section when wrapped.

A particular advantage of the transmission line cable of the invention is that every signal conductor is shielded from all adjacent signal conductors by ground planes formed by adjacent ground conductors, thereby greatly inhibiting crosstalk between the signal conductors. Thus, with reference to FIG. 5, signal conductor 41 is completely surrounded by ground conductors 43. Unlike the round cable made by folding ribbon cable, there are no signal conductors which are directly adjacent to each other. When even greater shielding is desired, the signal conductors can be spaced farther apart by simply transmitting the signals through signal conductors which are spaced farther apart, such as conductors 41 and 45 as opposed to conductors 41 and 47, or by spacing the signal conductors farther apart within each segment. Greater shielding can also be produced by including more ground wires in each segment and/or by increasing the size of the ground wires, or all of the above.

The transmission line cable of the invention, therefore, provides more consistent electrical characteristics than prior constructions in which ribbon cable is folded into a round configuration. At the same time, it maintains the ability to be mass terminated since the conductors are locked into a fixed relationship within the cable. Accordingly, the cable of the invention combines the advantageous shielding and handling properties of round cable with the installation advantages of ribbon cable in a manner heretofore unknown to the art.

In making the transmission line cable of the invention, the appropriate transmission line segments are continuously fed in line to a point where they are stacked together in interlocking relation to produce the desired cross sectional configuration. A gradual twist or lay is imparted to each segment to improve flexibility of the resulting cable, as is well known in the cable making art. The stacked segments are wrapped with a tape, such as a polyester tape or metal laminate tape, as is conventional in the cabling art. A metal braid may be applied over this structure to provide added shielding and strength properties if necessary or desirable. Finally, a polymer jacket is extruded over the structure to provide the final jacketed transmission line cable.

Figure 6:
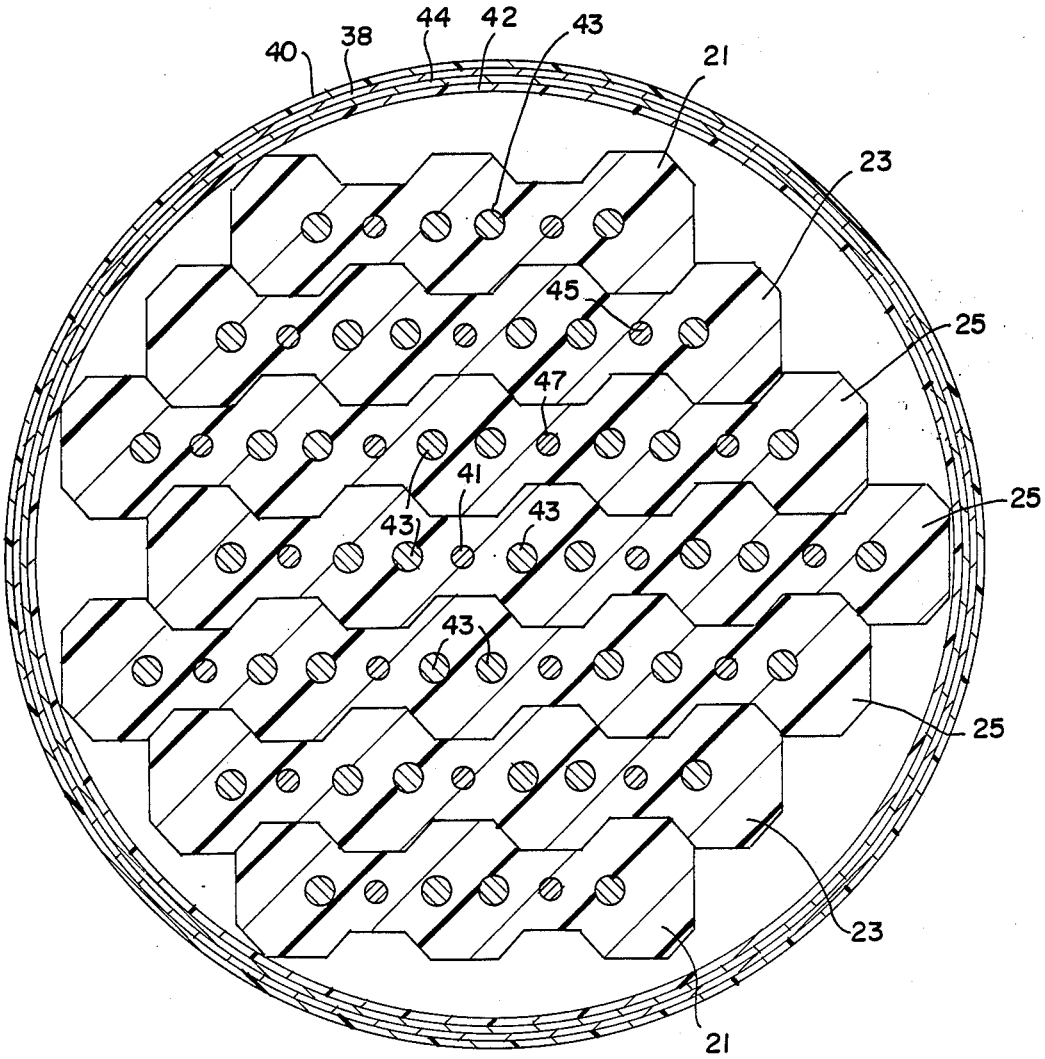
FIG. 6 is a cross sectional view of another transmission line cable of the invention.

Referring to FIG. 5, the stacked segments are shown wrapped with polyester tape 37. Metal braid 38 is applied over the tape followed by polymer jacket 40. FIG. 6 shows an alternative structure in which polyester tape 37 (FIG. 5) is replaced with a metal laminate tape having an inner polyester tape 42 and an outer metal layer 44 laminated thereto.

While the present invention has now been described in terms of certain preferred embodiments, one skilled in the art will readily appreciate that various modifications, changes, omissions and substitutions may be made without departing from the spirit thereof. It is intended, therefore, that the present invention be limited solely by the scope of the following claims.

I claim:

1. A transmission line cable comprising:

a pluality of generally flat transmission line segments stacked together, each segment comprising a generally flat insulating material having disposed therein at least one signal conductor and at least one ground conductor adjacent to said signal conductor, each segment having alternating regions of reduced and expanded thickness to receive corresponding regions of expanded and reduced thickness in an adjacent segment when the segments are stacked together, said segments being stacked together such that every signal conductor is adjacent to at least one ground conductor, thereby inhibiting cross talk between the signal conductors, and a protective jacket surrounding the plurality of stacked transmission line segments.

2. The transmission line cable as defined by claim 1, wherein said tramsmission line segments are of varying widths.

3. The tramsmission line cable as defined by claim 2, wherein said transmission line segments are stacked together in such a manner as to form a tramsmission line cable having a round cross section.

4. The transmission line cable as defined by claim 1, wherein said plurality of stacked transmission line segments are wrapped with a polymeric tape.

5. The transmission line cable as defined by claim 1, wherein said plurality of stacked transmission segments are wrapped with a metal laminate tape.

6. The transmission line cable as defined by claim 4, wherein a metal braid is applied over said tape.

7. The transmission line cable as defined by claim 5, wherein a metal braid is applied over said tape.

8. The transmission line cable as defined by claim 1, containing seven transmission line segments, two of which contain two signal conductors, two of which contain three signal conductors and three of which contain four signal conductors.

9. The transmission line cable as defined by claim 1, wherein said regions of expanded thickness have an octagonal shape.

10. The transmission line cable as defined by claim 1, wherein said signal conductor has ground conductors disposed on opposite sides thereof.

* * * * *